US005293725A

United States Patent [19]

Matticks et al.

[11] Patent Number: 5,293,725

[45] Date of Patent: Mar. 15, 1994

[54] BUILDING STRUCTURE WITH INTERLOCKING COMPONENTS

[76] Inventors: Richard B. Matticks, 28501 Elmira, Livonia, Mich. 48150; Michael H. Kinzel, 3451 Westwood, Dearborn, Mich. 48124

[21] Appl. No.: 955,478

[22] Filed: Oct. 2, 1992

[51] Int. Cl.[5] ..... E04B 1/343

[52] U.S. Cl. ..... 52/271; 52/79.5; 52/79.9; 52/92.2; 52/126.1; 52/264; 52/266; 52/483.1; 52/489.1

[58] Field of Search ..... 52/79.5, 79.9, 90.1, 52/92.1, 92.2, 126.1, 233, 261, 264, 266, 270, 271, 272, 281, 284, 474, 483, 589, 480, 126.5, 126.6, 155, 157

[56] References Cited

U.S. PATENT DOCUMENTS

| | | | |
|---|---|---|---|
| 1,402,438 | 1/1922 | Nichols | 52/233 |
| 1,459,761 | 6/1923 | Andrews | 52/92.1 |
| 1,516,096 | 11/1924 | Hahn | 52/92 X |
| 1,600,647 | 9/1926 | Teilborg | 52/92.2 |
| 1,618,696 | 2/1927 | Bermis | 52/92.2 X |
| 1,902,136 | 3/1933 | Mills | 52/270 |
| 2,138,958 | 12/1938 | Corbett et al. | 52/126.6 X |
| 2,234,114 | 3/1941 | Hifford | 52/589 |
| 2,291,712 | 8/1942 | Hatton | 52/272 |
| 2,403,934 | 7/1946 | Lindstrom | 52/233 |
| 3,002,315 | 10/1961 | Kuhn | 52/264 X |
| 3,076,286 | 2/1963 | Czecholinski | 52/480 |
| 3,236,014 | 2/1966 | Edgar | 52/589 X |
| 3,305,982 | 2/1967 | Steel | 52/90.1 |
| 3,369,335 | 2/1968 | Smith | 52/270 |
| 3,511,001 | 5/1970 | Morgan | 52/480 |
| 3,543,462 | 12/1970 | Spratt et al. | 52/264 |
| 3,908,322 | 9/1975 | Shoaf | 52/233 |
| 4,742,657 | 5/1988 | Veech | 52/233 |
| 5,036,634 | 8/1991 | Lessard et al. | 52/264 X |

FOREIGN PATENT DOCUMENTS

| | | | |
|---|---|---|---|
| 0002463 | 1/1991 | Japan | 52/126.1 |
| 0325135 | 2/1991 | Japan | 52/233 |
| 0110248 | 5/1991 | Japan | 52/126.1 |
| 0985148 | 3/1965 | United Kingdom | 52/126.6 |

*Primary Examiner*—Carl D. Friedman
*Assistant Examiner*—Robert J. Caufield
*Attorney, Agent, or Firm*—Peter D. Keefe

[57] ABSTRACT

A building structure requiring virtually no fasteners for its assembly, composed generally of a plurality of mutually interlocking floor panels which rest upon a plurality of floor stringers, a plurality of uprights interlocked with respect to the floor panels, a plurality of wall panels interlocked with respect to the uprights, a header rail on each left and right wall of the building structure fastened to adjoining uprights and interlocked with adjoining sidewall panels, a plurality of mutually interlocked roof trusses which are fastened to the header rails, and a plurality of roof panels interlocked with the roof trusses and adjoining rail header. The aforesaid interlocking relationships are provided by a male-female structural interrelationship between adjoining interlocking components. The building structure according to the present invention is further preferably provided with a self-leveling feature which connects with the floor stringers and floor panels. It is further preferred that the aforesaid components be constructed of a durable, corrosion resistant material, such as a plastic, and most preferably a recycled plastic.

19 Claims, 6 Drawing Sheets

132e
132a
132b
132j
132e
132b
132c
132d
132d
132c
132'
132
132h
138
138a 132j
132a
132b
132c
132d
132e
132i
132'
132e
132b
132c
132d 132e
132d
132f
132j
132"
132"
132e
132d 132e
132d
132g
132f
132e
132d
132
132g
132"
132h
138a
138

132
132h
108
136a
138a 132
138h
138
138a
108
136
136a
11
108
11

140
134b
144
134c
134
142
134a 140
134b
144
134c
13
134
142
134a
13

134
132e
132'
132e
134c
134
168
178
178
178
152
164
152'a
158
160'
154a
152
152a
154c
154b
150
152a'
152a
134c
18
18
152a'
152a
162b
132i
132j
152
160
134
132e
132'
134
154b
162
154a
150c
140
152a
174
152b
150
142
154c
150b
158
142
134
134
16
140
16
134
15
15
134

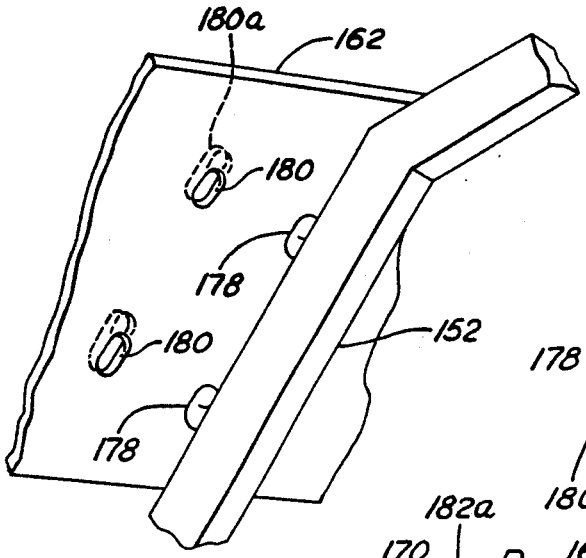
FIG.19
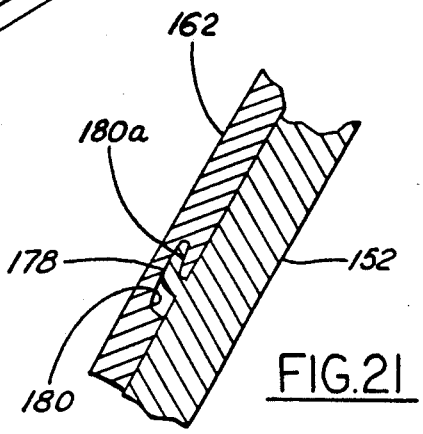
FIG.21
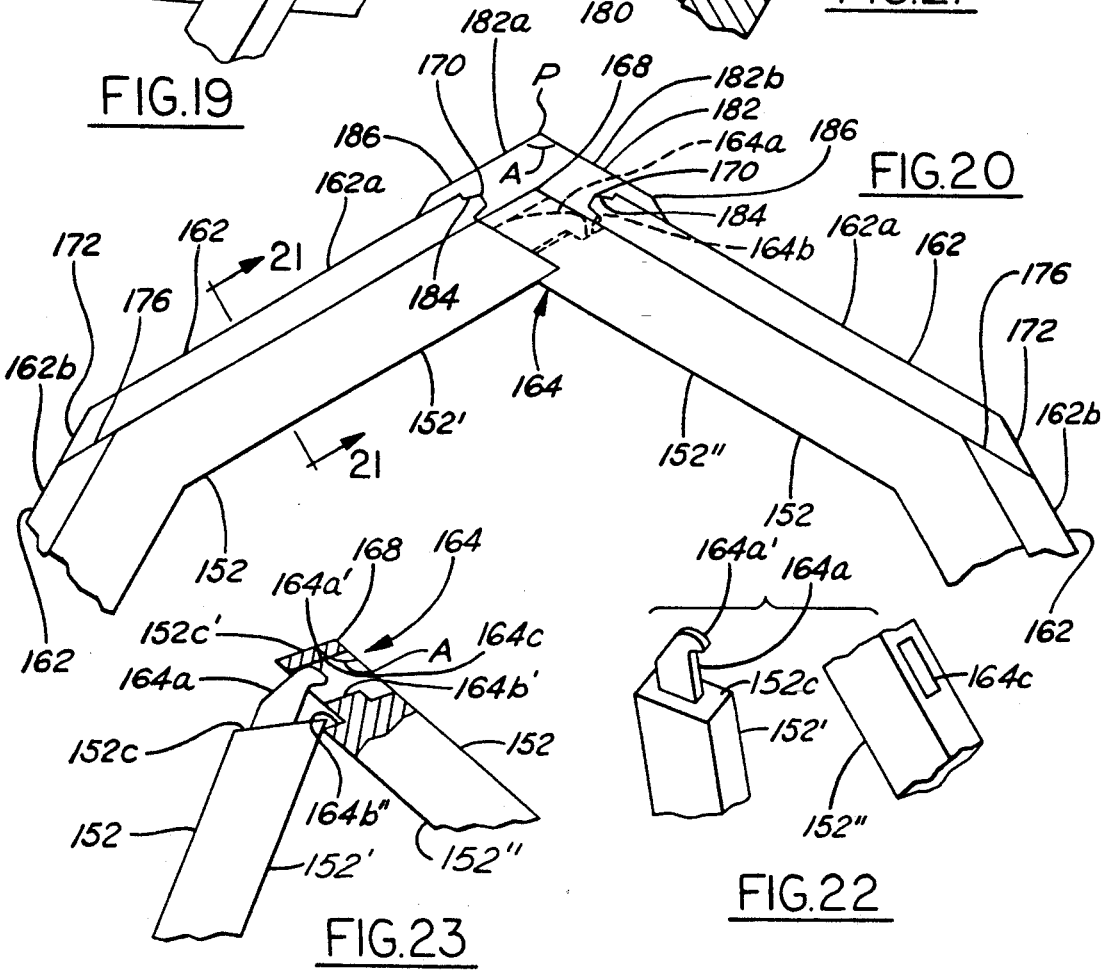
FIG.20
FIG.22
FIG.23

BUILDING STRUCTURE WITH INTERLOCKING COMPONENTS

BACKGROUND OF THE INVENTION

1. Field of the Invention

The present invention relates to building structures, particularly shed and related outbuilding structures, and more particularly to such a building structure of the aforesaid class having mutually interlocking components for facilitating assembly and disassembly.

2. Description of the Prior Art

In the prior art, sheds and other outbuilding structures are constructed of wood wall panels on a wood frame, metal wall panels on a metal frame, or combinations thereof. In the case of metal construction, it is known to provide an interlocking relationship between mutually adjoining wall panel members. However, in any combination of these construction techniques and building materials, there is required a plentiful use of fasteners, such as screws, nails, bolts, and the like. The effort and complexity of assembly of these structures is compounded by the need to secure these fasteners at appropriate locations and junctures in the assembly process. Also, a variety of tools are necessary, such as hammers, screwdrivers, wrenches, and the like in order to operate the fasteners with respect to the structure. Further still, once assembled, the structure is generally not susceptible to disassembly, especially in nailed-together construction. And, even in the case of fasteners which may be removable, such as screws and bolts, their large number and their likely corroded condition after several years of weather exposure make the job of disassembly quite undesirable.

Accordingly, what is needed is a building structure which is assembled using essentially no fasteners, is easily assembled and disassembled by an average homeowner, is strong, is inexpensive, and is preferably constructed of durable, environmentally friendly materials.

SUMMARY OF THE INVENTION

The building structure according to the present invention is composed of a plurality of components structured for providing selective mutual interlock therebetween so as to provide a building structure which is assembled using essentially no fasteners, is easily assembled and disassembled by an average homeowner, is strong, is inexpensive, and is preferably constructed of durable, environmentally friendly materials.

The building structure according to the present invention is composed generally of a plurality of mutually interlocking floor panels which rest upon a plurality of floor stringers, a plurality of uprights interlocked with respect to the floor panels, a plurality of wall panels interlocked with respect to the uprights, a header rail on each left and right wall of the building structure fastened to adjoining uprights and interlocked with adjoining sidewall panels, a plurality of mutually interlocked roof trusses which are fastened to the header rails, and a plurality of roof panels interlocked with the roof trusses and adjoining rail header. The aforesaid interlocking relationships are provided by a male-female structural interrelationship between adjoining interlocking components.

The building structure according to the present invention is further preferably provided with a self-leveling feature which connects with the floor stringers and floor panels. It is further preferred that the aforesaid components be constructed of a durable, corrosion resistant material, such as a plastic, and most preferably a recycled plastic.

Accordingly, it is an object of the present invention to provide a building structure which is composed of a plurality of components which selectively interconnect interlockingly, thereby minimizing use of fasteners.

It is another object of the present invention to provide a building structure which is composed of a plurality of components which selectively interconnect interlockingly, wherein the components may be simply and easily assembled and disassembled with a minimum use of tools and effort.

It is a further object of the present invention to provide a building structure which is composed of a plurality of components which selectively interconnect interlockingly, which is durable, strong and relatively inexpensive.

It is yet another object of the present invention to provide a building structure which is composed of a plurality of components which selectively interconnect interlockingly, wherein the components are made of a plastic, particularly a recycled plastic.

It is a further object of the present invention to provide a building structure which is composed of a plurality of components which selectively interconnect interlockingly, wherein the building structure is provided with a self-leveling feature.

It is a further object of the present invention to provide a building structure which is composed of a plurality of components which selectively interconnect interlockingly, wherein the structure is attractive, functional and environmentally friendly.

It is a further object of the present invention to provide a building structure which is composed of a plurality of components which selectively interconnect interlockingly, wherein components may be mixed and matched, made in different sizes, colors, etc., so as to provide a variety of building structure configurations, sizes and looks.

These, and additional objects, advantages, features and benefits of the present invention will become apparent from the following specification.

BRIEF DESCRIPTION OF THE DRAWINGS

FIG. 19 is an exploded perspective view of a roof truss and a roof panel according to the present invention.

FIG. 20 is a partly sectional end view of the roof according to the present invention.

FIG. 21 is a sectional end view of the roof, seen along lines 21—21 in FIG. 20.

FIG. 22 is a detail of a preferred roof truss interconnection structure, wherein a male member is provided on one roof truss of an aligned pair of roof trusses, and a female member is provided on the other of an aligned pair of roof trusses.

FIG. 23 is a partly sectional side view of two roof trusses being mutually interconnected according to the male and female members depicted in FIG. 22.

DETAILED DESCRIPTION OF THE PREFERRED EMBODIMENT

Figure 1:
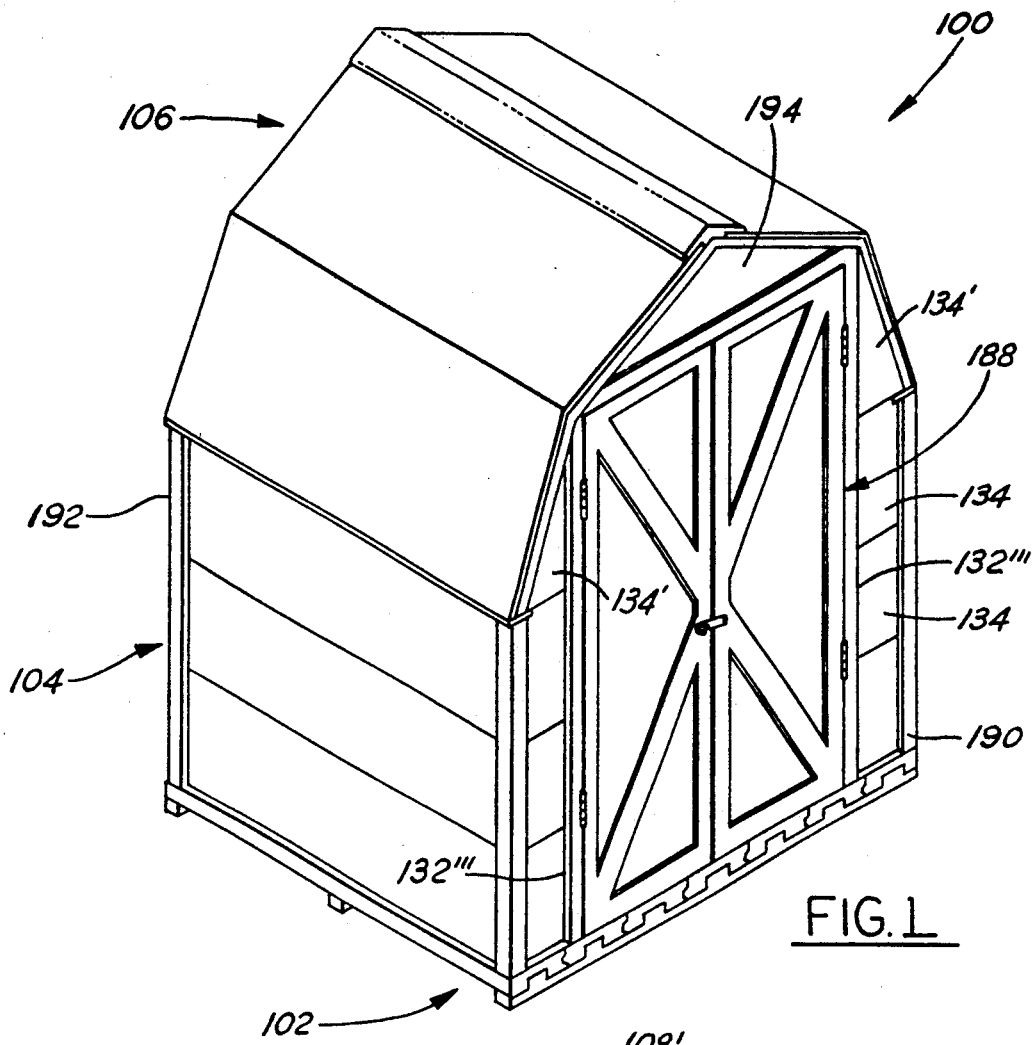
FIG. 1 is a perspective view of a building structure according to the present invention.

Referring now to the Drawing, FIG. 1 shows the building structure 100 according to the present invention. As can be discerned therefrom, the building structure 100 is composed generally of three major components: a floor 102, a plurality of sidewalls 104, and a roof 106. Each of these components are structured for being mutually selectively interconnected so as to essentially obviate need of fasteners, as will become understood from the description hereinbelow. It is preferred for the components to be constructed of a durable, strong, noncorrosive material, such as plastic, and most preferably recycled plastic.

Firstly, assembly of the building structure 100 involves assembly of the floor 102. The floor 102 is composed of a plurality of floor panels 108 and a plurality of floor stringers 110. The floor panels 108 shown in the Drawing are flat and are of an elongate rectangular shape, however, the exact shape thereof can be different for a particular building structure shape. One longitudinal edge 108*a* of each of the floor panels 108 is provided with a tongue 112. The other longitudinal edge 108*b* of each of the floor panels 108 is provided with a groove 114. As can be discerned from FIG. 2, the floor panels 108 are arranged sequentially in a side-by-side relationship and mutually adjoining floor panels are interconnected by the tongues 112 seating into the grooves 114. Preferably, the outer floor panels 108′ are not provided with an external facing groove or tongue (as shown), but this is not a requirement, as this is preferred for aesthetic purposes. In order that the floor panels 108 remain interconnected via the tongues 112 and grooves 114, the floor panels 108 must be held in the aforesaid side-by-side relationship. Accordingly, the floor panels 108 are provided on the underside 108*c* thereof with a stringer slot 116, and the plurality of floor stringers 110 are provided with stringer bosses 118 which are dimensioned and spaced so as to interfit snugly with each of the stringer slots 116. A completed floor 102 is shown in FIG. 5.

Figure 3:
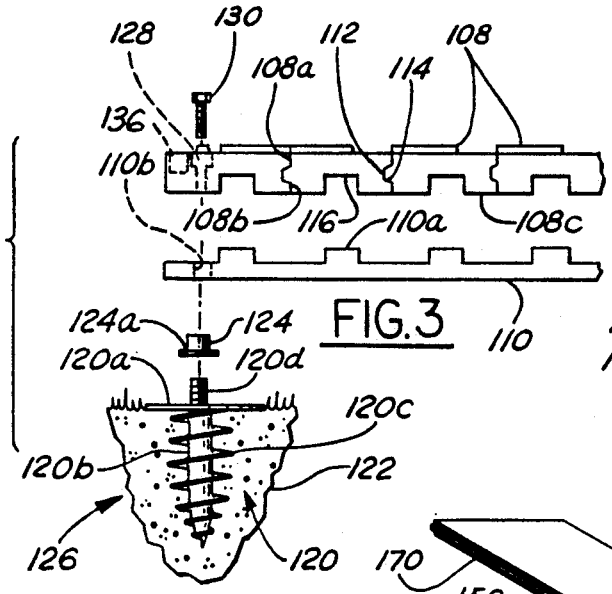
FIG. 3 is an exploded edge view of the floor, seen along lines 3—3 in FIG. 2, also showing a side view of a floor leveler according to the present invention for connecting with the floor.
Figure 4:
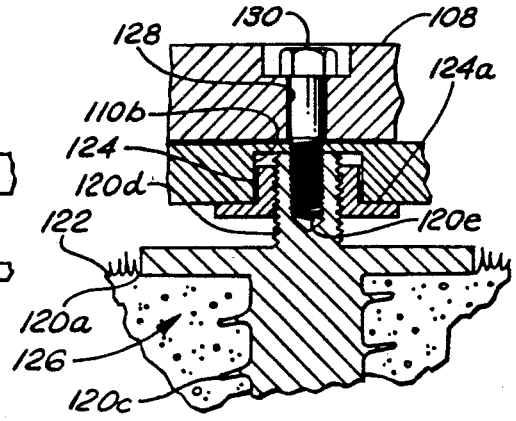
FIG. 4 is a detail view of the floor and floor leveler components according to the present invention, shown in operation with respect to the ground.

FIGS. 3 and 4 also show aspects of floor construction and further show how the floor 102 is secured to the ground. A plurality of ground anchors 120 are provided, each having a plate 120*a* and a shank 120*b*. On one side of the plate 120*a*, the shank 120*b* is provided with a coarse tapering screw-thread structure 120*c* for penetrating into soil 122. On the other side of the plate 120*a*, the shank 120*b* is provided with a threaded portion 120*d* for being threaded with respect to a leveler nut 124. The leveler nut 124 is provided with an annular rim 124*a* structured for interfacing with an adjoining floor stinger 110. The combination of a ground anchor 120 and an associated leveler nut 124 provides a leveler 126 for providing level adjustment and anchorage of the floor stringers 110.

As can be discerned from FIGS. 3 and 4, once the levelers 126 are in place in the ground and the leveler nuts 124 are adjusted on the threaded portion 120*d* of the ground anchor 120 so as to provide a common level height with respect to all the levelers, the floor stringers are placed onto the levelers via holes 110*b* so that the floor stringers rest level on the annular rims 124*a*. The threaded portion 120*d* of each of the shanks 120*b* is provided with a threaded blind bore 120*e*. A plurality of fastener holes 128 are provided in the floor panels 108 and are positioned therein so as to be aligned with the threaded portion 120*d* of a respective ground anchor 120. A bolt 130 is placed through each of the aligned holes 128, 110*b* in the floor panel and the floor stringers and then threaded tightly into the aligned blind bore 120*e* of the leveler 126. A leveler 126 is placed at each corner and wherever additionally needed between corners for providing adequate, uniform structural support of the floor 102. The hole 128 in the floor panels may or may not be located within stepped notches 136 of the floor panels, the stepped notches being discussed hereinbelow.

Figure 5:
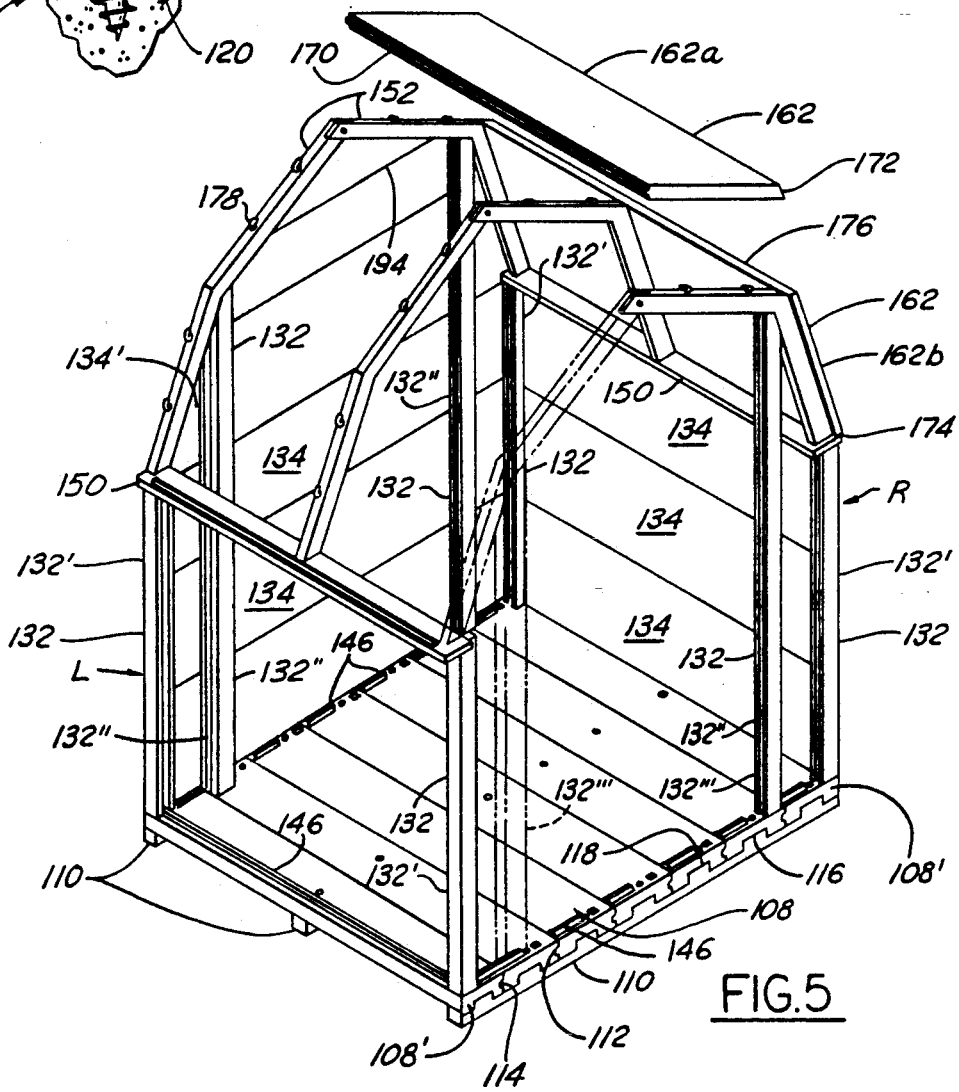
FIG. 5 is a partly exploded perspective view of the building structure according to the present invention, showing floor, sidewall and roof construction details.

Turning now to assembly of the plurality of sidewalls 104, FIG. 5 shows that there are a plurality of uprights 132 which interconnect with the floor 102. A plurality of sidewall panels 134 interconnect with the uprights and selectively with the floor panels 108. This structural interrelationship will be made clear with reference being additionally had to the greater specificity afforded by FIGS. 6 through 16.

Figures 6, 7, 8, 9, 10, 11, 12, 13:
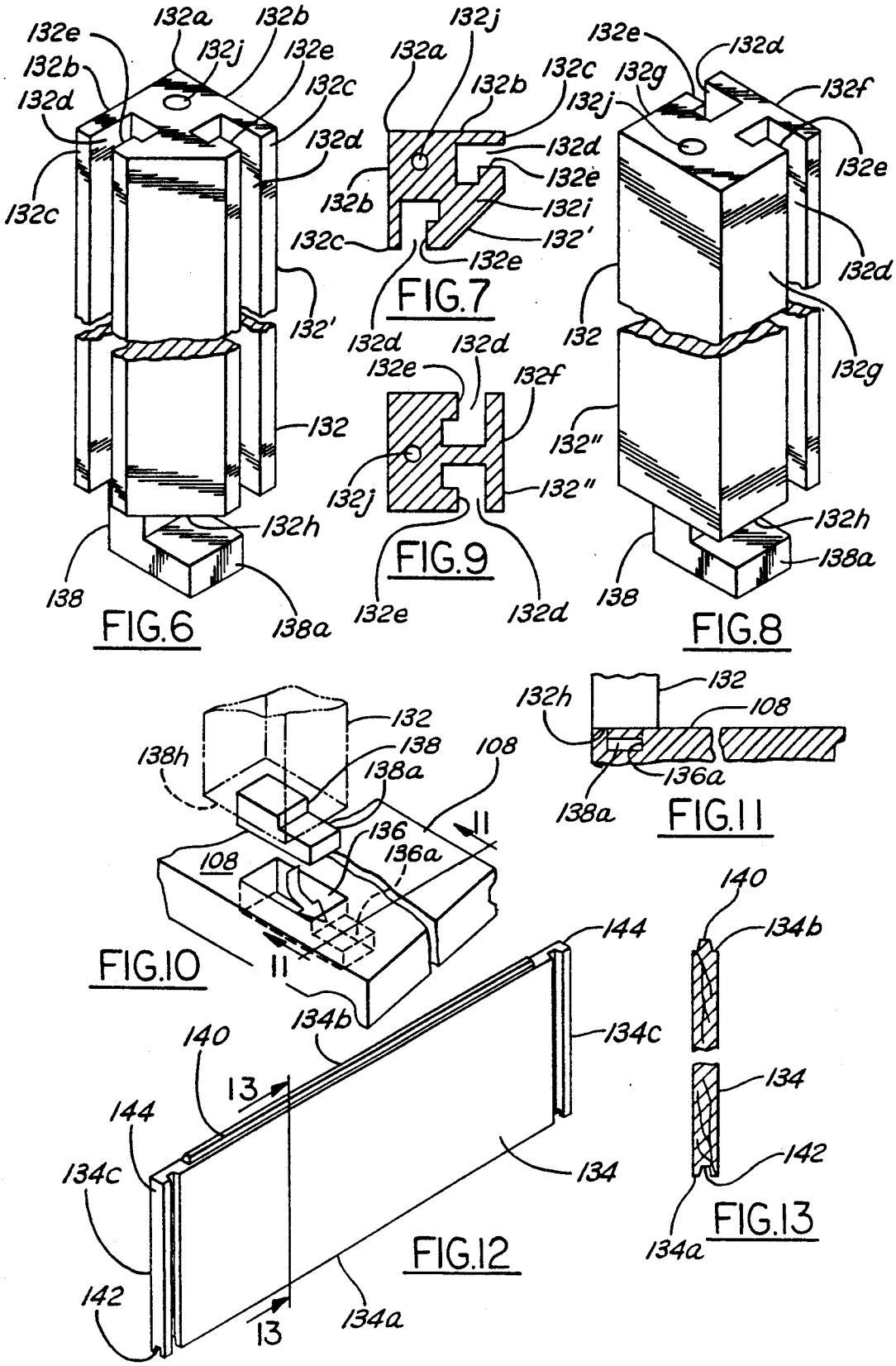
FIG. 6 is a perspective view of an upright according to the present invention which serves as a corner post.
FIG. 7 is a top plan view of the upright shown in FIG. 6.
FIG. 8 is a perspective view of an upright according to the present invention which serves as a sidewall post.
FIG. 9 is a top plan view of the upright shown in FIG. 8.
FIG. 10 is an exploded perspective view depicting interconnection between the floor and the uprights according to the present invention.
FIG. 11 is a partly sectional side view of the upright and floor seen along lines 11—11 in FIG. 10.
FIG. 12 is a perspective view of a sidewall according to the present invention.
FIG. 13 is a sectional end view of the sidewall, seen along lines 13—13 in FIG. 12.

Firstly, the uprights 132 are installed. FIGS. 6 and 7 show an upright 132 structured for use as a corner post 132'. The corner post 132' has a corner 132a defined by two sides 132b that are normal to each other. The longitudinal end 132c of each of the two sides is provided with an L-shaped groove 132d running the length thereof. Each L-shaped groove provides a boss 132e, and each of the L-shaped grooves 132d is normal with respect to the other.

FIGS. 8 and 9 show an upright 132 structured for use as a side post 132". The side post 132" has a side 132f, and two sides 132g that are normal thereto. The two sides 132g are each provided with the aforesaid L-shaped groove 132d, running the length thereof. Again, as indicated hereinabove with respect to the corner post 132', each L-shaped groove 132d provides a boss 132e, however, with regard to the side post 132" each of the L-shaped grooves is parallel with respect to the other.

The uprights 132, whether they be corner posts 132' or side posts 132", are connected with respect to the floor 102 utilizing the same structure. In this regard, the floor panels 108 of the floor 102 are provided with stepped notches 136, in which a blind step portion 136a is provided in each. The bottom 132h of each of the uprights 132 has connected therewith a stepped boss 138, in which a step portion 138a is provided. As can be understood by particular reference to FIGS. 10 and 11, an upright is tilted to permit the stepped boss 138 to insert into the stepped notch 136 so that the step portion 138a seats into the blind step portion 136a. Thereupon, the upright 132 is righted. In this relative position, the bottom 132h of the upright 132 rests supportably upon the subject floor panel 108 having the respective stepped notch 136. Because of the interfering relationship between the stepped boss 138 and the blind step portion 136a, the uprights 132 are held in position vertically, as well as laterally, with respect to the floor 102.

Figures 14, 15, 16, 18:
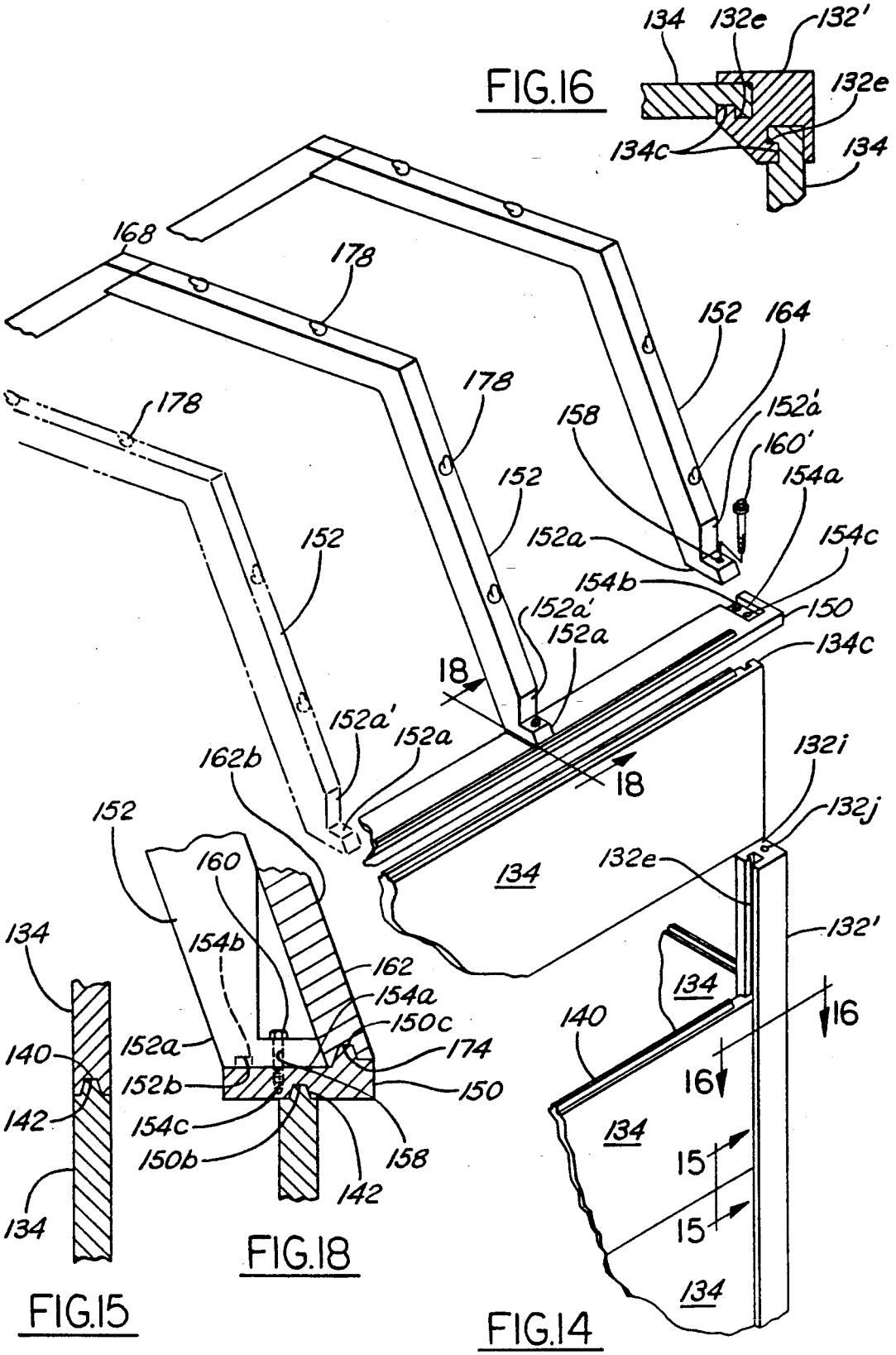
FIG. 14 is a partly exploded, detailed perspective view of the building structure according to the present invention, showing selected aspects of sidewall and roof construction.
FIG. 15 is a sectional end view of an interconnection between sidewall panels, seen along lines 15—15 in FIG. 14.
FIG. 16 is a sectional top view showing an upright serving as a corner post interconnected with adjoining sidewalls, seen along lines 16—16 in FIG. 14.
FIG. 18 is a sectional end view of the rail header shown connecting with a roof truss, a roof panel and a sidewall, seen along lines 18—18 in FIG. 14 with respect to an assembled building structure according to the present invention.

Secondly, the sidewall panels 134 are installed. As can be discerned from FIGS. 12 and 13, the sidewall panels 134 are of a relatively thin planar shape of a size and weight that is easy for an average person to handle, although this is not a requirement. The sidewall panels may be of rectangular shape, or of any other shape; for instance a triangular shape sidewall panel may be used in order to provide for its fit at a particular location of the front or rear sidewall of the building structure 100. The sidewall panels 134 are provided with a tongue 140 on one longitudinal end 134b thereof and a groove 142 on the opposite longitudinal end 134a thereof. The sidewall panels 134 are arranged sequentially in a side-by-side relationship at each sidewall of the building structure 100, wherein the tongue 140 of one sidewall panel and the groove 142 of a mutually adjoining sidewall panel are dimensioned so as to seatably interlock with each other, as shown in FIG. 15. Each lateral end 134c of each sidewall panel 134 is provided with an L-shaped boss 144 which is dimensioned to interlock with the L-shaped grooves in the uprights 132, as shown in FIG. 16. As can be understood from FIG. 14, the sidewall panels 134 are connected with the corner posts 132' by sliding the L-shaped boss 144 into the L-shaped groove 132d from a top end 132i of the respective corner post; this same procedure applies to the side posts 132".

Figure 2:
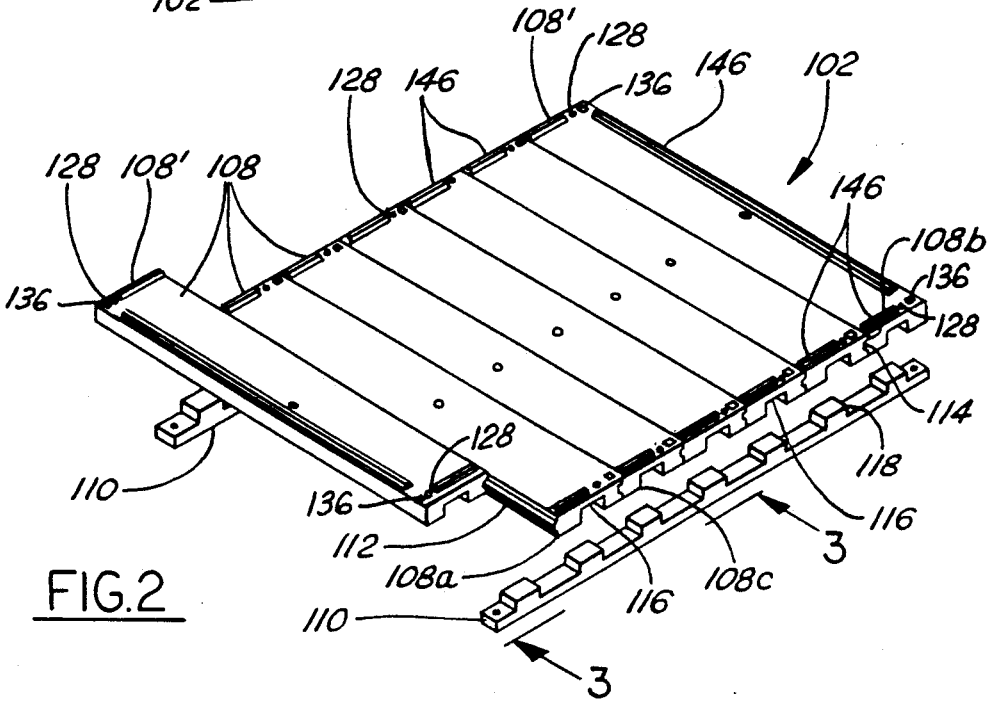
FIG. 2 is a partly exploded perspective view of the floor of the building structure according to the present invention.

In order that the sidewall panels 134 seatably interlock with the floor 102, the floor panels 108 are provided with perimeter tongues 146 located, as shown in FIGS. 2 and 5, along the floor perimeter wherever the floor members will be adjoining the sidewall panels. In this respect, the groove 142 in the lowermost sidewall panels 134 adjoining the floor 102 receive the perimeter tongues 146.

Figure 17:
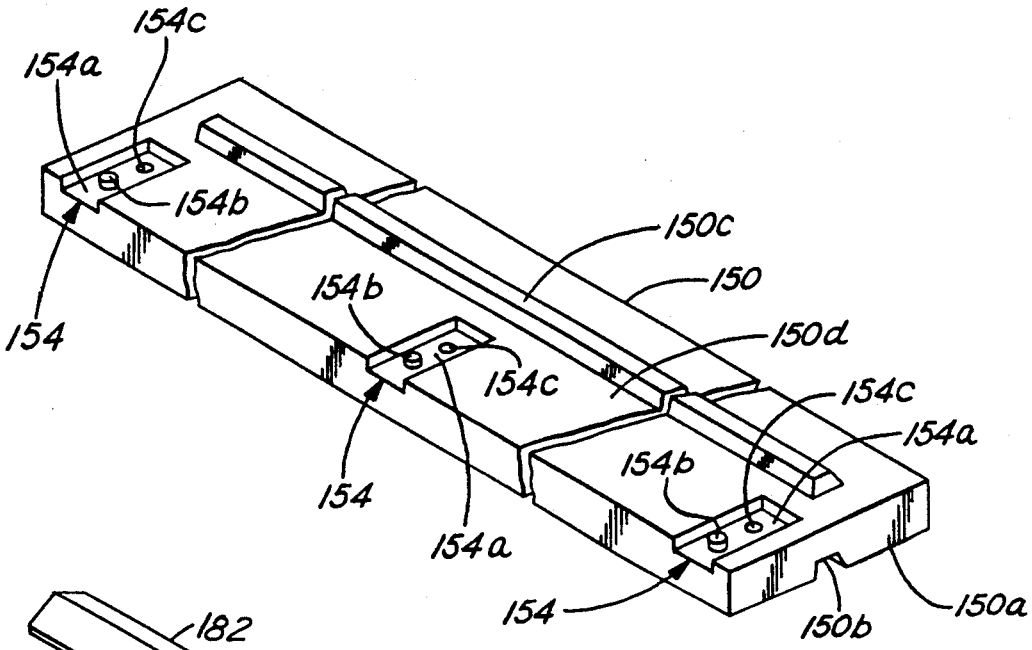
FIG. 17 is a perspective view of a rail header according to the present invention.

Now it is time to install the roof 106. Firstly, a rail header 150 must be placed atop the uppermost sidewall panel 134 on each of the left L and right R sides of the building structure 100 so that the roof trusses 152 (shown in FIGS. 14 and 18) will have a solid attachment point. The rail header 150, as can be discerned from FIG. 17, is structured in the form of a thick, planar member dimensioned to run the length of either of the left L and right R sides of the building structure 100; the left and right sides each have a rail header because these sides support the roof trusses 152 in the presently detailed embodiment. Of course, in building structures 100 which are rather long in dimension, two or more rail headers 150 may be placed along each left and right side thereof; and other building structures of other shapes may have the rail headers located differently, per the roof pitch design. The bottomside 150a of each rail header 150 is provided with a groove 150b which is dimensioned to interlock seatably with the tongue 140 of the adjoining uppermost sidewall panel 134. A plurality of roof truss seats 154 are provided in the upper side 150d of each of the rail headers 150. Each roof truss seat 154 includes a recess 154a dimensioned to coincide with the cross-section of a foot end 152a of a roof truss 152 (see FIG. 14), a nib 154b for being received in an alignment hole 152b of the foot end of the roof truss (see FIG. 18), and an attachment hole 154c. The rail headers 150 are placed onto the adjoining uppermost sidewall member 134, as shown in FIG. 14, with the groove 142 of the sidewall panel seatably interlocking with the groove 150b of the rail header.

Next, the roof trusses 152 are installed, as shown in FIG. 14. In this regard, the foot end 152a of each of the roof trusses 152 is structured to include a shoulder 152a'. Each foot end 152a is dimensioned to seatably fit into a recess 154a of a respective roof truss seat 154 when a nib 154b thereof inserts into an alignment hole 152b of the respective roof truss foot end 152a (see FIG. 18). A hole 158 is provided through the foot end 152a of each of the roof trusses 152. Where no upright 132 is located alignably thereunder (as shown in FIG. 18), a short bolt 160 passes through the hole 158 in the foot end 152a of a respective roof truss and then screws into the attachment hole 154c of the rail header 150. Where an upright 132 is located alignably thereunder (as shown in FIG. 14), a long bolt 160' passes through the hole 158 in the foot end 152a of a respective roof truss 152, through the rail header, and then screws into a connection hole 132j in the top 132i of the upright 132.

The roof trusses 152 are preferred to be composed of two parts for ease of handling, a first roof truss component 152' and a second roof truss component 152". The first and second roof truss components are connected at the peak ends thereof 152c, 152c' via a roof truss interlock 164. A plurality of roof trusses 152 are mutually spaced apart along the rail headers 150 so as to serve as support for the roof panels 162, as shown in FIGS. 5 and 20. The roof truss interlock 164 for accomplishing formation of each of the roof trusses 152 preferably utilize (see FIGS. 20, 22 and 23) a male member 164a on the first roof truss component 152' and a female member on the second roof truss component 152". The male member 164a has a curved tip 164a' which extends from a straight-cut peak end 152c of the first roof truss component 152'. The female member 164b has a side-slot 164c off-set from the peak end 152c' of the second roof truss component 152'', the side-slot having a boss 164b' and a recess 164b''. The male member 164a and the female member 164b are structured to mutually interlock seatably while the surrounding structure of the aligned pair of first and second roof truss components mutually abuts so as to provide a solid interlock at the appropriate angle A of the peak 168 defined at the female member 164b.

The actual shape of each of the roof trusses 152 may be varied as desired for a particularly desired shape building structure 100. Shown in FIG. 14 are roof trusses 152 structured to mate into integrated roof trusses 166 which provide a gambrel style roofline, as shown in FIG. 1; mansard, hip, gable, and other types of roof styles may be alternatively provided (with adjustment of placement of the rail headers 150, as needed) with appropriately shaped roof trusses 152.

Roof panels 162 are planar in shape, as shown in FIG. 5, similar to the sidewall panels 134. In the case of a gambrel roof, as shown in the Drawing, an upper roof panel 162a includes a tongue 170 on one longitudinal end thereof and a bevel cut 172 on the opposite longitudinal end thereof, while a lower roof panel 162b includes a groove 174 on one longitudinal end thereof (see FIG. 18) and a bevel cut 176 on the opposite longitudinal end thereof. The upper and lower roof panels 162a, 162b are arranged sequentially in a side-by-side relationship on said plurality of roof trusses. Other roof styles, such as the gable roof, would involve a modification of this, as grooves and tongues may be substituted for the bevel cut ends, as needed to provide mutual interlock of the roof panels 162 in the manner of the sidewall panels 134.

The roof panels 162 are interconnected with the roof trusses 152 via a plurality of hooks 178 on the roof trusses which engage key-slots 180 on the roof panels, as shown with particularity in FIG. 19. The key-slots 180 are structured to receive the hooks 178 with the roof panel at a first position relative to the roof truss, then the roof panel 162 is slid away from the peak 168 along the roof truss so as to interlock the hooks 178 with a key portion 180a of the key-slots 180, as shown in FIG. 21. The lower roof panels 162b are installed first on the roof trusses 152 with the groove 174 thereof interlocking with a tongue 150c provided on the rail header 150 (as shown in FIGS. 17 and 18), followed by the upper roof panels 162a.

Figure 24:
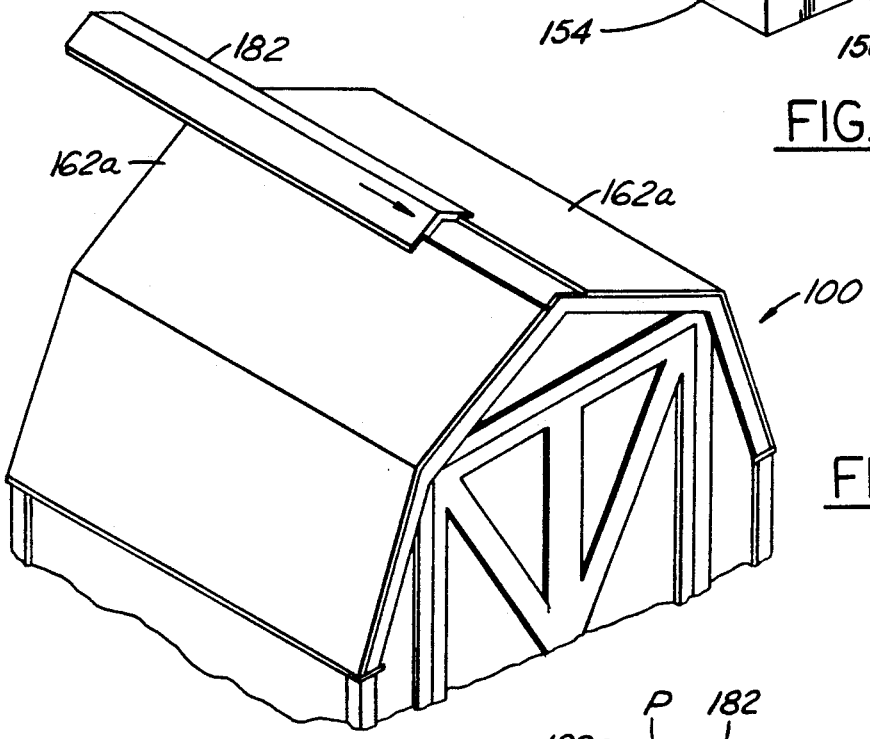
FIG. 24 is a perspective view of the building structure according to the present invention, showing installation of the peak locking panel which thereupon completes assembly of the building structure.
Figure 25:
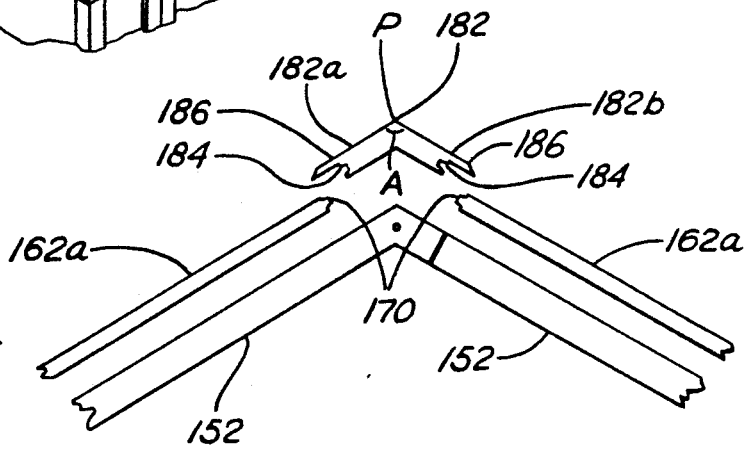
FIG. 25 is an exploded front view of the roof according to the present invention.

Now what remains to be installed is a peak locking panel 182 having a pair of peak sides 182a, 182b which define a peak P which follows the peak angle A (see FIGS. 20 and 25). Each of the peak sides 182a, 182b terminate in a groove 184. Adjacent each groove 184 is an overhand 186. As shown in FIG. 24, the peak locking panel 182 is slid along the tongues 170 (see FIGS. 20 and 25) on each of the adjoining upper roof panels 162a until the final position shown in FIG. 1 is achieved. The overhang 186 provides protection against rain leakage.

Final assembly now involves construction of a conventional door assembly 188 connected (such as by screw attached hinges) with pre-designated uprights 132''', as shown in FIG. 1.

It should be noted that the front 190 and rear 192 of the building structure 100 is provided with tapering sidewall panels 134' where abutting contact is made with an adjoining roof truss 152. A gable shaped sidewall panel 194 is installed above the door assembly 188 and at the gable in the rear 192 of the building structure 100 (see FIGS. 1 and 5). Where abutment of a sidewall panel with a roof truss 152 occurs, no tongue on the sidewall panel is preferably present, although a tongue and groove relationship therebetween could be provided.

From the foregoing, it will be clear to those of ordinary skill in the relevant art that the only threaded fasteners needed, excepting those associated with the levelers, are those used to connect the roof trusses and their respectively adjoining rail header to the respectively adjacent sidewall and (where present) the respectively adjacent upright. As a result, practically all of the steps of assembly involve interlocking interconnection between parts without need of tools. And, once assembled according to the steps recounted hereinabove, the resulting building structure according to the present invention is solidly held together in a manner extremely resistant to disassembly, except by reversal of the aforesaid assembly steps. Accordingly, the building structure according to the present invention is durable against severe weather conditions and attempts at unauthorized entry.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A building structure, comprising:

a plurality of floor panels, each floor panel of said plurality of floor panels being arranged sequentially in a side-by-side relationship, said plurality of floor panels defining a perimeter having a plurality of sides;

first interlock means on each said floor panel for interlocking mutually adjoining floor panels of said plurality of floor panels to one another;

a plurality of floor stringers oriented transverse to said plurality of floor panels for supporting said plurality of floor panels;

second interlock means for interlocking each of said plurality of floor panels to said plurality of floor stringers so as to retain said adjoining floor panels in said side-by-side relationship, each floor stringer of said plurality of floor stringers being mutually spaced a predetermined distance apart for providing support to said plurality of floor panels;

a plurality of uprights oriented perpendicular with respect to said plurality of floor panels;

third interlock means connected with each upright of said plurality of uprights and floor panels of said plurality of floor panels for interlocking each said upright to said plurality of floor panels;

a plurality of sidewall panels arranged sequentially in a side-by-side relationship at predetermined sides of said plurality of sides;

fourth interlock means on each said sidewall panel for interlocking mutually adjoining sidewall panels of said plurality of sidewall panels to one another;

fifth interlock means on each upright of said plurality of uprights and each said sidewall panel for providing interlocking connection between each said sidewall panel and each said upright that is mutually adjoining thereto;

sixth interlock means on said plurality of floor panels adjacent said perimeter thereof and on a plurality of sidewall panels adjacent said plurality of floor panels for interlocking said plurality of sidewall panels adjacent said plurality of floor panel to said plurality of floor panels;

a plurality of roof trusses;

rail header means adjoining predetermined sidewall panels of said plurality of sidewall panels and connected with said plurality of uprights adjoining thereto for supporting said plurality of roof trusses;

a plurality of roof panels arranged sequentially in a side-by-side relationship on said plurality of roof trusses;

seventh interlock means on each roof truss of said plurality of roof trusses and each said roof panel of said plurality of roof panels for providing interlocking connection between said roof panels and said roof trusses;

eighth interlock means on roof panels of said plurality of roof panels adjoining said rail header means and on said rail header means for interlocking said plurality of roof panels with respect to said rail header means;

a peak lock panel for providing a peak with respect to said plurality of roof panels;

ninth interlock means located on said peak lock panel and on roof panels of said plurality of roof panels that adjoin said peak lock panel for providing interlocking connection between said plurality of roof panels and said peak lock panel; and door assembly means connected with said plurality of uprights for providing selective access to the building structure.

2. The building structure of claim 1, further comprising leveler means for leveling said plurality of floor panels with respect to ground level.

3. The building structure of claim 2, wherein said leveler means comprises a plurality of levelers located in a predetermined pattern between said floor stringers and ground level, each leveler of said plurality of levelers comprising:

a shank having a threaded portion at a first end section thereof, said first end section having a threaded blind bore;

coarse screw means connected to a second end section of said shank for being screwed into soil below ground level;

a plate connected with said shank between said first and second end sections thereof for contacting the soil and forming a resting surface with respect thereto;

a leveler nut threadably connected with said threaded portion of said shank, said leveler nut having an annular rim for engaging a floor stringer of said plurality of floor stringers; and threaded fastener means for threadably engaging said threaded blind bore so as to connect a floor panel of said plurality of floor panels with a floor stringer of said plurality of floor stringers to said shank;

wherein said leveler nut is threaded with respect to said threaded portion of said shank so as to provide a predetermined location upon which to rest said floor stringer that is in a plane common with all said levelers.

4. The building structure of claim 2, wherein said first interlock means comprises:

a tongue located on a first longitudinal end of substantially all said floor panels; and a groove located on a second longitudinal end of substantially all said floor panels, said second longitudinal end being opposite said first longitudinal end;

wherein adjoining floor panels are interlocked by the tongue of one floor panel seating into the groove of an adjoining floor panel.

5. The building structure of claim 4, wherein each said floor panel has an underside, said second interlock means comprising:

a stringer slot located on said underside of each said floor panel; and a plurality of stringer bosses provided on each floor stringer;

wherein each stringer boss of said plurality of stringer bosses interfits snugly with a respective stringer slot.

6. The building structure of claim 5, wherein each said upright has a bottom, said third interlock means comprising:

stepped notches provided on said floor panels adjacent said perimeter, each stepped notch including a blind step portion; and a stepped boss located at said bottom of each said upright, said stepped boss including a step portion;

wherein said step portion of each upright of said plurality of uprights is trapped within a respective blind step portion when each said upright is oriented perpendicular with respect to said plurality of floor panels.

7. The building structure of claim 6, wherein said fourth interlock means comprises:

a tongue located on a first longitudinal end of substantially all said sidewall panels; and a groove located on a second longitudinal end of substantially all said sidewall panels, said second longitudinal end being located opposite said first longitudinal end;

wherein adjoining sidewall panels are interlocked by the tongue of one sidewall panel seating into the groove of an adjoining sidewall panel.

8. The building structure of claim 7, wherein each sidewall panel has a first lateral end and an opposite second lateral end, said fifth interlock means comprising:

a pair of mutually spaced apart L-shaped grooves extending longitudinally along each said upright, each L-shaped groove of said pair of L-shaped grooves having a predetermined orientation with respect to each other; and an L-shaped boss located on each of said first and second lateral ends of each said sidewall panel;

wherein each said L-shaped boss of said first and second lateral sides of each sidewall panel is slid into an L-shaped groove of respectively adjoining uprights of said plurality of uprights so as to interlock each sidewall panel with respect to the adjoining uprights at a location substantially adjacent said perimeter.

9. The building structure of claim 8, wherein said sixth interlock means comprises:

tongue means on each said floor panel adjacent said perimeter for seatably engaging with respect to sidewall panels of said plurality of sidewall panels which are adjoining thereto.

10. The building structure of claim 9, wherein said seventh interlock means comprises:

a plurality of hooks located on each roof truss of said plurality of roof trusses; and key-slots located in each roof panel of said plurality of roof panels, each key-slot having a key portion;

wherein each hook of said plurality of hooks is received into a respective key-slot of said plurality of key-slots so as to be trapped therein by said key portion thereof.

11. The building structure of claim 10, wherein each said roof truss terminates at each end thereof in a foot end, said eighth interlock means comprising:

roof truss seat means on said rail header means for seatably receiving each said foot end of said plurality of roof trusses;

tongue means on said rail header means;

groove means on said plurality of roof trusses adjoining said rail header means, said tongue means on said rail header means being seatably received by said groove means on said plurality of roof trusses adjoining said rail header means;

groove means on said rail header means, said groove means on said rail header means seatably receiving said tongue of said sidewall panels adjoining thereto; and fastener means for fastening said foot end of each said roof truss to said rail header means and for fastening said rail header means to said uprights that adjoin thereto.

12. The building structure of claim 11, wherein said ninth interlock means comprises:

groove means on said peak lock means, said groove means on said peak lock means seatably receiving said tongue of each said roof panel adjoining thereto.

13. The building structure of claim 12, wherein each said roof truss comprises:

a first roof truss component;

a second roof truss component; and roof truss interlock means for joining said first truss component with said second roof truss component so as to form said roof truss.

14. The building structure of claim 13, wherein each said interlock means cooperates with each other said interlock means to provide for disassembly of said building structure only by sequentially removing each said interlock means in the following order: said ninth interlock means, said eighth interlock means, said seventh interlock means, said sixth interlock means, said fifth interlock means, said fourth interlock means, said third interlock means, said second interlock means, and finally said first interlock means.

15. The building structure of claim 14, wherein said leveler means comprises a plurality of levelers located in a predetermined pattern between said floor stringers and ground level, each leveler of said plurality of levelers comprising:

a shank having a threaded portion at a first end section thereof, said first end section having a threaded blind bore;

coarse screw means connected to a second end section of said shank for being screwed into soil below ground level;

a plate connected with said shank between said first and second end sections thereof for contacting the soil and forming a resting surface with respect thereto;

a leveler nut threadably connected with said threaded portion of said shank, said leveler nut having an annular rim for engaging a floor stringer of said plurality of floor stringers; and threaded fastener means for threadably engaging said threaded blind bore so as to connect a floor panel of said plurality of floor panels with a floor stringer of said plurality of floor stringers to said shank;

wherein said leveler nut is threaded with respect to said threaded portion of said shank so as to provide a predetermined location upon which to rest said floor stringer that is in a plane common with all said levelers.

16. The building structure of claim 15, wherein each of said plurality of floor panels, said plurality of floor stringers, said plurality of uprights, said plurality of sidewall panels, said rail header means, and said peak lock panel are constructed of plastic.

17. The building structure of claim 16, wherein each said interlock means cooperates with each other said interlock means so as to provide for disassembly of said building structure only by sequentially removing each said interlock means in the following order: said ninth interlock means, said eighth interlock means, said seventh interlock means, said sixth interlock means, said fifth interlock means, said fourth interlock means, said third interlock means, said second interlock means, and finally said first interlock means.

18. The building structure of claim 17, wherein each of said plurality of floor panels, said plurality of floor stringers, said plurality of uprights, said plurality of sidewall panels, said rail header means, and said peak lock panel are constructed of plastic.

19. A building structure, comprising:

a plurality of floor panels, each floor panel of said plurality of floor panels being arranged sequentially in a side-by-side relationship, said plurality of floor panels defining a perimeter having a plurality of sides;

first interlock means on each said floor panel for interlocking mutually adjoining floor panels of said plurality of floor panels to one another;

a plurality of floor stringers oriented transverse to said plurality of floor panels for supporting said plurality of floor panels;

second interlock means for interlocking each of said plurality of floor panels to said plurality of floor stringers so as to retain said adjoining floor panels in said side-by-side relationship, each floor stringer of said plurality of floor stringers being mutually spaced a predetermined distance apart for providing support to said plurality of floor panels;

a plurality of uprights oriented perpendicular with respect to said plurality of floor panels;

third interlock means connected with each upright of said plurality of uprights and floor panels of said plurality of floor panels for interlocking each said upright to said plurality of floor panels;

a plurality of sidewall panels arranged sequentially in a side-by-side relationship at predetermined sides of said plurality of sides;

fourth interlock means on each said sidewall panel for interlocking mutually adjoining sidewall panels of said plurality of sidewall panels to one another;

fifth interlock means on each upright of said plurality of uprights and each said sidewall panel for providing interlocking connection between each said sidewall panel and each said upright that is mutually adjoining thereto;

sixth interlock means on said plurality of floor panels adjacent said perimeter thereof and on a plurality of sidewall panels adjacent said plurality of floor panels for interlocking said plurality of sidewall panels adjacent said plurality of floor panels to said plurality of floor panels;

a plurality of roof trusses;

rail header means adjoining predetermined sidewall panels of said plurality of sidewall panels and connected with said plurality of uprights adjoining thereto for supporting said plurality of roof trusses;

a plurality of roof panels arranged sequentially in a side-by-side relationship on said plurality of roof trusses;

seventh interlock means on each roof truss of said plurality of roof trusses and each said roof panel of said plurality of roof panels for providing interlocking connection between said roof panels and said roof trusses;

eighth interlock means on roof panels of said plurality of roof panels adjoining said rail header means and on said rail header means for interlocking said plurality of roof panels with respect to said rail header means;

a peak lock panel for providing a peak with respect to said plurality of roof panels;

ninth interlock means located on said peak lock panel and on roof panels of said plurality of roof panels that adjoin said peak lock panel for providing interlocking connection between said plurality of roof panels and said peak lock panel;

door assembly means connected with said plurality of uprights for providing selective access to the building structure; and a plurality of levelers located in a predetermined pattern between said floor stringers and ground level, each leveler of said plurality of levelers comprising:

a shank having a threaded portion at a first end section thereof, said first end section having a threaded blind bore;

coarse screw means connected to a second end section of said shank for being screwed into soil below ground level;

a plate connected with said shank between said first and second end sections thereof for contacting the soil and forming a resting surface with respect thereto;

a leveler nut threadably connected with said threaded portion of said shank, said leveler nut having an annular rim for engaging a floor stringer of said plurality of floor stringers; and threaded fastener means for threadably engaging said threaded blind bore so as to connect a floor panel of said plurality of floor panels with a floor stringer of said plurality of floor stringers to said shank;

wherein said leveler nut is threaded with respect to said threaded portion of said shank so as to provide a predetermined location upon which to rest said floor stringer that is in a plane common with all said levelers.

* * * * *